US008235388B1

(12) United States Patent
Itkis et al.

(10) Patent No.: US 8,235,388 B1
(45) Date of Patent: Aug. 7, 2012

(54) REMOTELY CONTROLLED BALL BLOWER AND METHOD OF USING THE SAME

(75) Inventors: Yuri Itkis, Las Vegas, NV (US); Horia Mihai Preda, Las Vegas, NV (US); Ioan M. Puscas, Las Vegas, NV (US)

(73) Assignee: Fortunet, Inc., Las Vegas, NV (US)

( * ) Notice: Subject to any disclaimer, the term of this patent is extended or adjusted under 35 U.S.C. 154(b) by 101 days.

(21) Appl. No.: 12/854,756

(22) Filed: Aug. 11, 2010

Related U.S. Application Data

(63) Continuation-in-part of application No. 12/043,086, filed on Mar. 5, 2008, now Pat. No. 7,775,521.

(60) Provisional application No. 60/893,035, filed on Mar. 5, 2007.

(51) Int. Cl.
*A63F 3/06* (2006.01)
*A63F 9/06* (2006.01)

(52) U.S. Cl. ..... 273/144 A; 273/144 B; 273/144 R; 273/138.2; 463/19; 463/39

(58) Field of Classification Search ..... 273/144 A, 273/144 B, 144 R, 138.2, 138.1, 143 R, 269; 463/17–20, 39
See application file for complete search history.

(56) References Cited

U.S. PATENT DOCUMENTS

| | | | | |
|---|---|---|---|---|
| 5,257,784 | A | 11/1993 | Boylan et al. | |
| 5,590,879 | A | 1/1997 | Tripp | |
| 5,799,940 | A | 9/1998 | Tripp | |
| 6,120,024 | A | 9/2000 | Lind | |
| 7,887,417 | B2 * | 2/2011 | Tyndall et al. | 463/35 |
| 2004/0204225 | A1 | 10/2004 | Campo et al. | |
| 2007/0108700 | A1 | 5/2007 | Bigelow | |
| 2008/0054561 | A1 * | 3/2008 | Canterbury et al. | 273/148 B |
| 2008/0265504 | A1 * | 10/2008 | Jones | 273/144 R |

* cited by examiner

*Primary Examiner* — Benjamin Layno
(74) *Attorney, Agent, or Firm* — Greenberg Traurig

(57) ABSTRACT

A system and method using one or more remote controllers to control hands-free ball blowers. The remote controllers may be used by bingo callers and/or a designated bingo player. In addition, the remote controllers are configured to enable bingo callers to override a designated bingo player's control of the ball-blowers if needed, e.g., if a player delays a drawing of a bingo ball for too long a time. The system and method allows players to be more interactive with bingo games and similar draw-type games.

24 Claims, 11 Drawing Sheets

REMOTELY CONTROLLED BALL BLOWER AND METHOD OF USING THE SAME

CROSS-REFERENCE TO RELATED APPLICATION

This application is a continuation-in-part of U.S. application Ser. No. 12/043,086 filed on Mar. 5, 2008, now U.S. Pat. No. 7,775,521 which claims the benefit of U.S. Provisional Patent Application No. 60/893,035 filed on Mar. 5, 2007, both of which are incorporated herein in their entirety by reference.

FIELD OF THE INVENTION

The embodiments of the present invention relate to gaming systems, more specifically, the embodiments relate to ball blowers operable as random number generators.

BACKGROUND

Heretofore, bingo ball blowers, have been operated by bingo callers, while bingo players have had no access to the ball blowers for obvious gaming integrity and security reasons. Conventionally, bingo players have no participation in the process of drawing bingo balls and feel powerless and disenfranchised relative to influencing the most important factor in the bingo game, i.e., the selection of called bingo balls. Such a passive role of bingo players affects negatively their interest in the game. Accordingly, it is one objective of the embodiments of the present invention to increase the players' degree of interest in bingo games and similar draw games (e.g., keno and lottery).

Accordingly, there is the need to increase the players' degree of interest in bingo games and similar draw games (e.g., keno and lottery).

SUMMARY

The embodiments of the present invention involve a radical departure from the conventional practice of keeping bingo players from any participation in the process of calling bingo numbers. On the contrary, at least one embodiment of the present invention passes virtually all responsibility for calling bingo numbers from bingo caller to bingo players by providing bingo players with a remote (wireless) controller for hands-free ball blowers. In addition, the embodiments of the present invention may enable bingo callers to override bingo players' control of the remote controller if needed, e.g., if a player delays a drawing of a bingo ball for too long a time.

Other variations, embodiments and features of the present invention will become evident from the following detailed description, drawings and claims.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
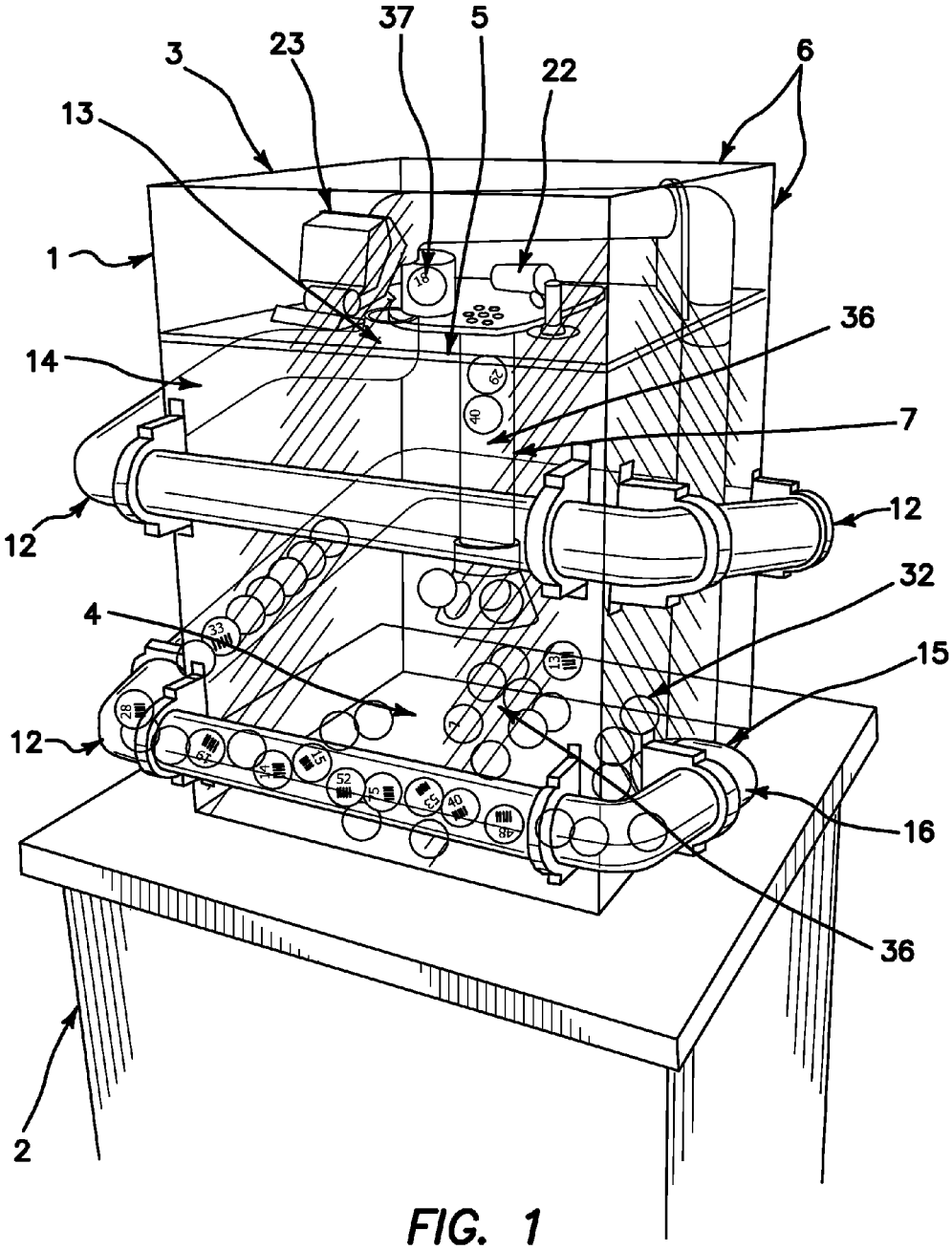
FIG. 1 illustrates a perspective view of an embodiment of the smart ball blower.

Initial reference is made to FIG. 1 showing an automatic ball blower having a ball mixing chamber 1 positioned on a support stand 2. In one embodiment, the mixing chamber 1 is fabricated of Plexiglas (or any suitable material) in the form of an inverted vertical hollow rectangular prism 3 finished by or glued to a pyramid 4, which can also be fabricated of Plexiglas (or any suitable material). As shown, the mixing chamber 1 is mounted upside down on the support stand 2. The upper portion of the mixing chamber 1 houses a horizontal support plate 5 that can be attached to the walls 6 of the mixing chamber 1 using screws and small mounting brackets or other suitable means. Like the mixing chamber 1, the support plate 5 is fabricated of Plexiglas (or any suitable material). Although the Plexiglas for the mixing chamber 1 and the support plate 5 is transparent as shown, it is understood that the Plexiglas can be partially transparent or opaque.

Figure 2:
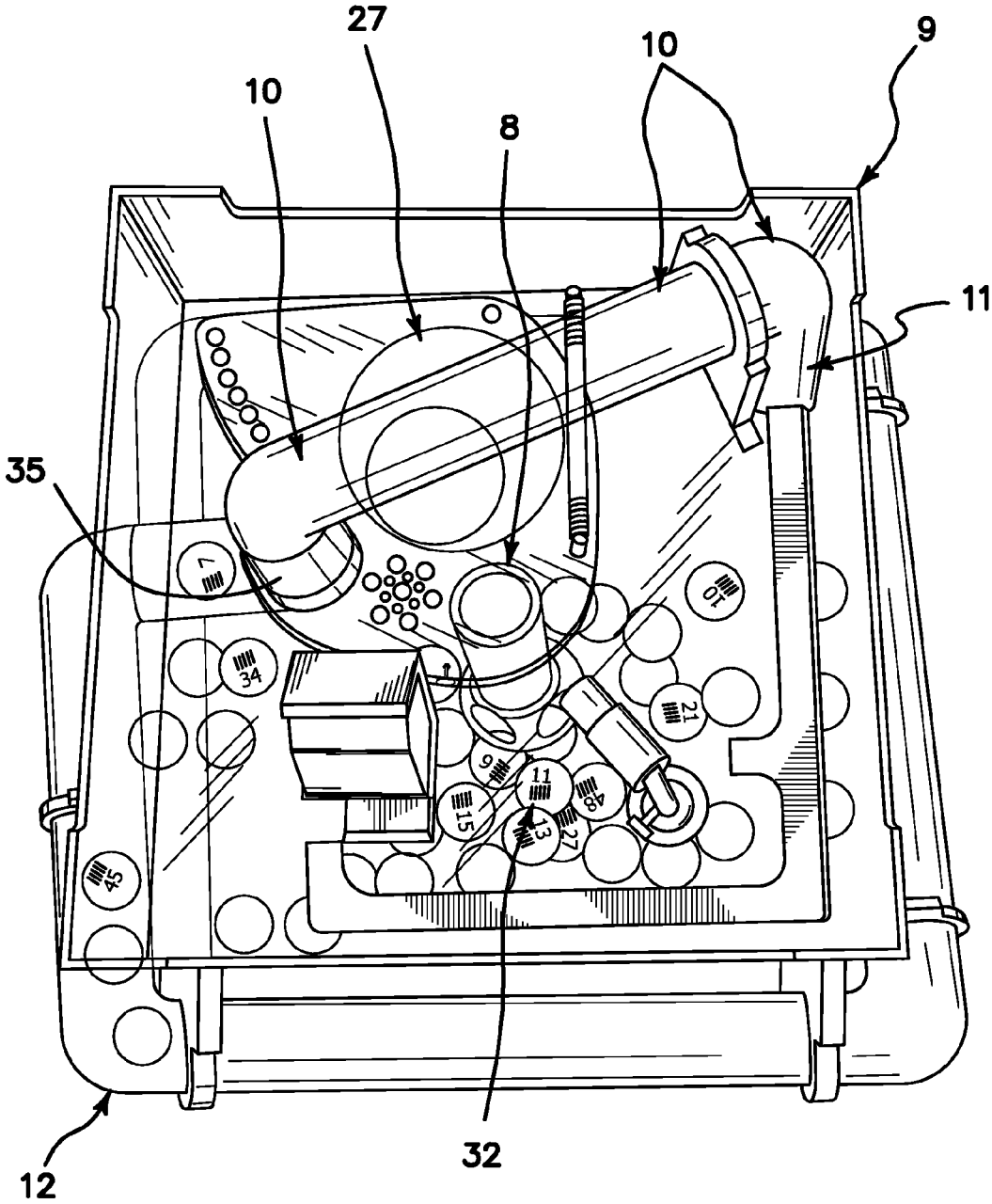
FIG. 2 illustrates an upper view of an embodiment of a smart ball blower.

Inside the mixing chamber 1 is a central ball ejection tube 7 attached to the support plate 5 through an opening 8 in the center of the support plate 5 as best shown in FIG. 2. Also inside the mixing chamber 1, near a corner 9, is a reverse U-shaped auxiliary tube 10 that pierces through the support plate 5 at a circular opening 11. Like the mixing chamber 1, the ejection tube 7 and the auxiliary tube 10 can be fabricated of Plexiglas or other suitable materials.

A spiraling ball return tube 12 circumscribes the exterior surface of the mixing chamber 1. Although the return tube 12 is shown as a circular transparent tube positioned external to ball mixing chamber 1, the return tube 12 can also be implemented as a triangular or rectangular metal or any other cross-sectional shaped air duct on the exterior or interior surfaces of the mixing chamber 1. In addition, like the mixing chamber 1, the return tube 12 is fabricated of Plexiglas (or any suitable material) and can be completely or partially transparent.

Figure 3:
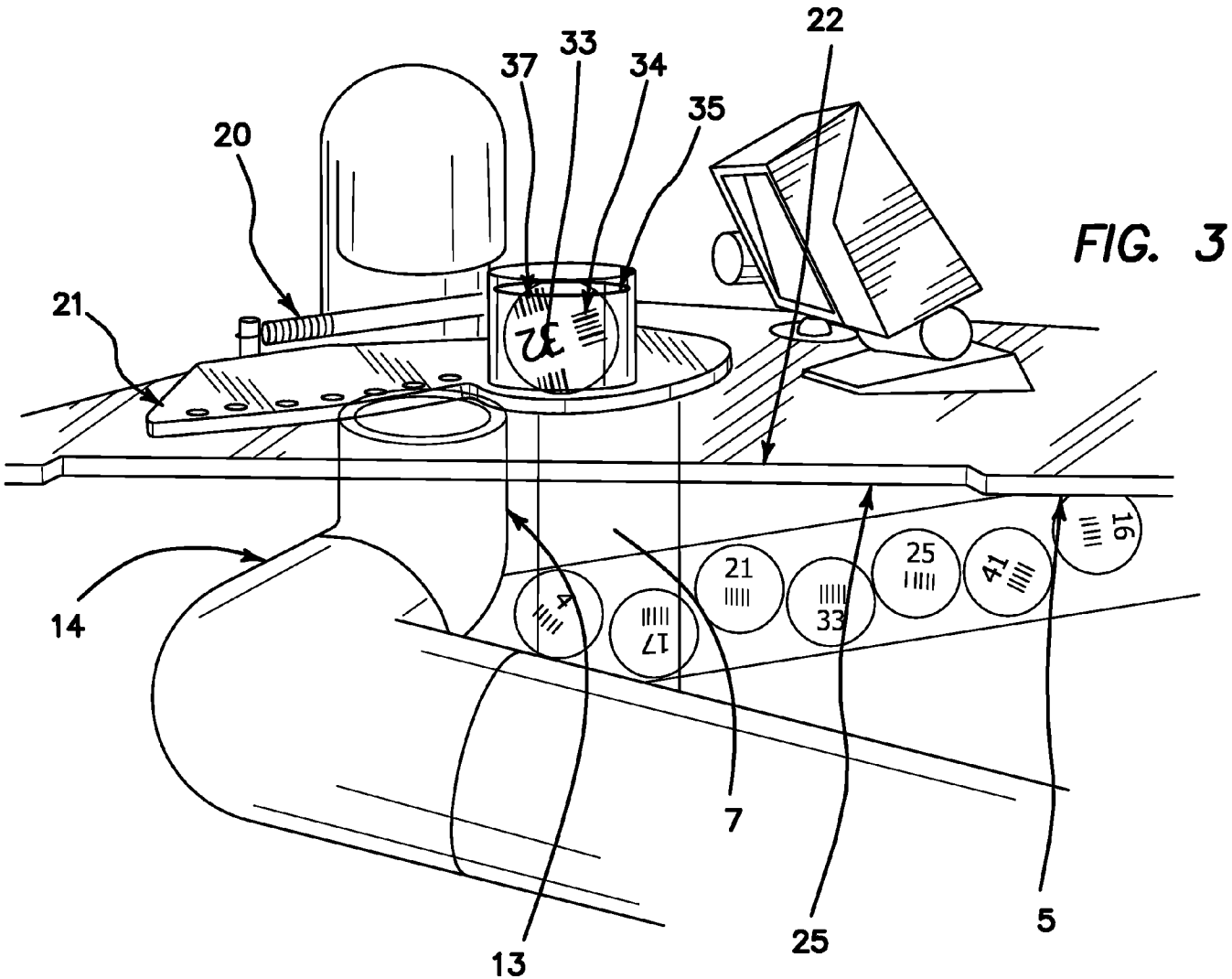
FIG. 3 illustrates a side view of a ball carriage mechanism.
Figure 5:
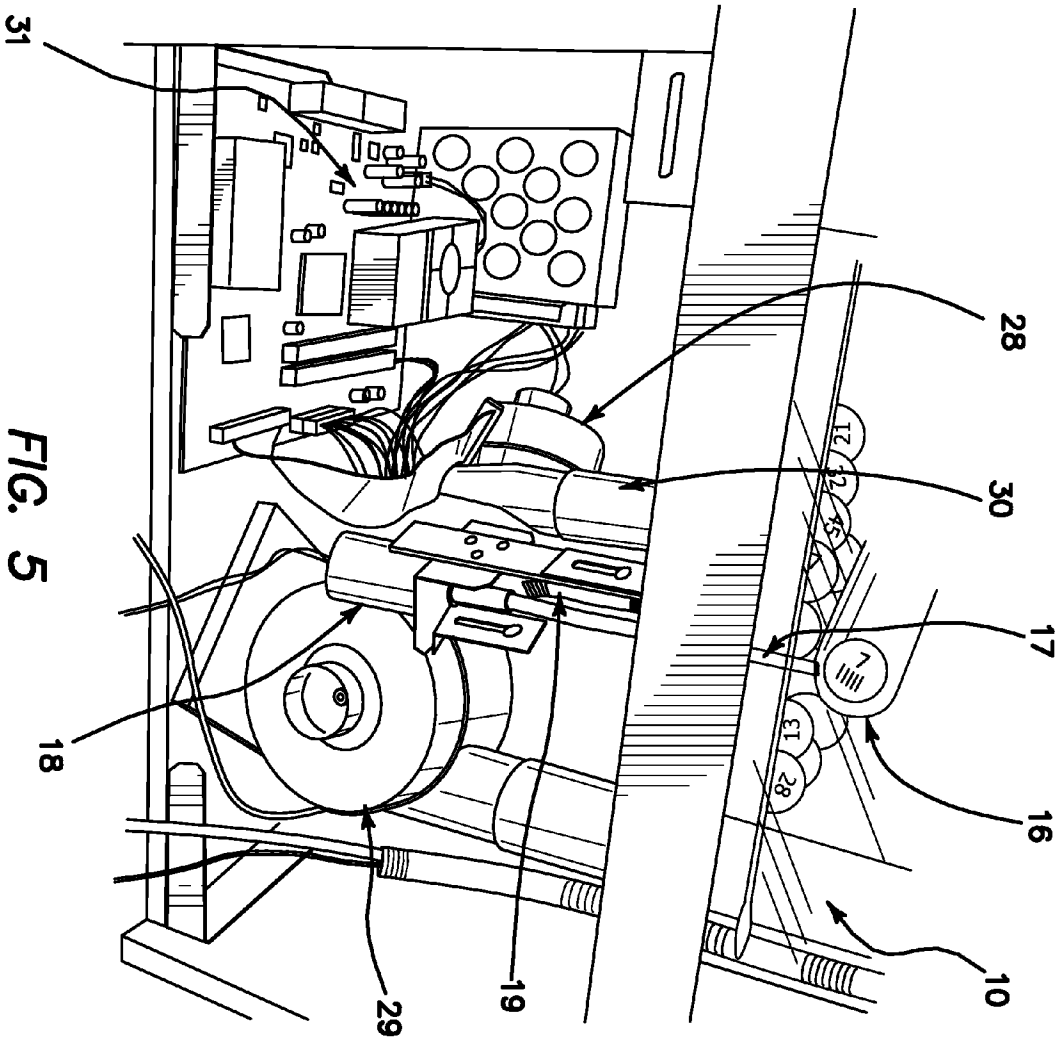
FIG. 5 illustrates a perspective view of a support stand with an access door in an open position.

An inlet 13 of the return tube 12 can be located inside the mixing chamber 1 under the support plate 5 as shown in FIG. 3. The body of the return tube 12 penetrates one of the walls 6 of the mixing chamber 1 at an upper point 14, curves around the exterior of the other walls 6 of the mixing chamber 1, and re-enters the mixing chamber 1 through an opening 15 located at a lower point of the mixing chamber 1. As best shown in FIG. 5, the bottom end of the return tube 12 forms a ball outlet 16 gated by a pull-in slidable and/or extendable metal or Plexiglas shaft 17 controlled by a solenoid 18. Biased by a spring 19, the shaft 17 normally closes, at least partially, the outlet 16.

Figure 4:
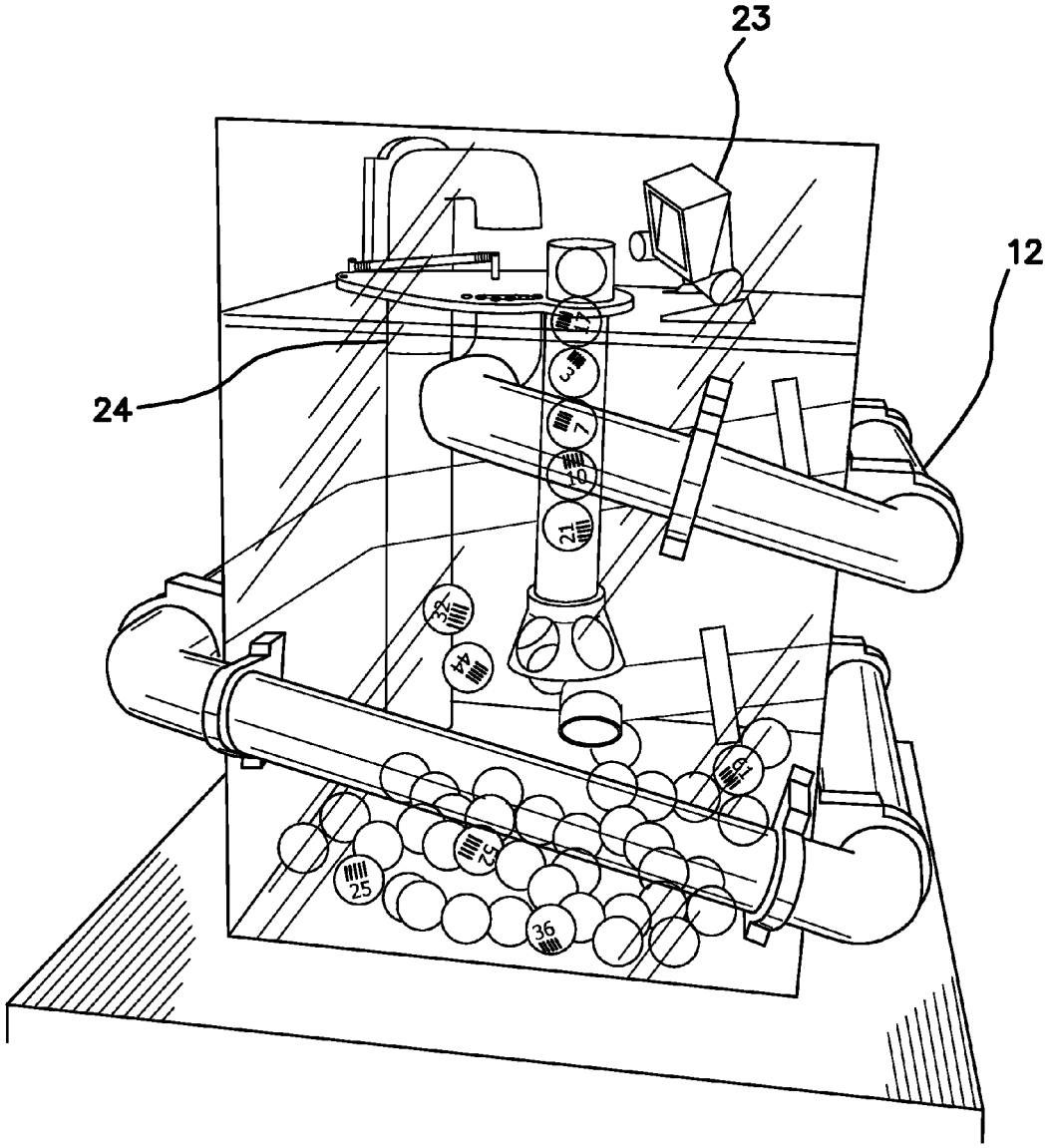
FIG. 4 illustrates a side view of an embodiment of a smart ball blower.
Figure 8:
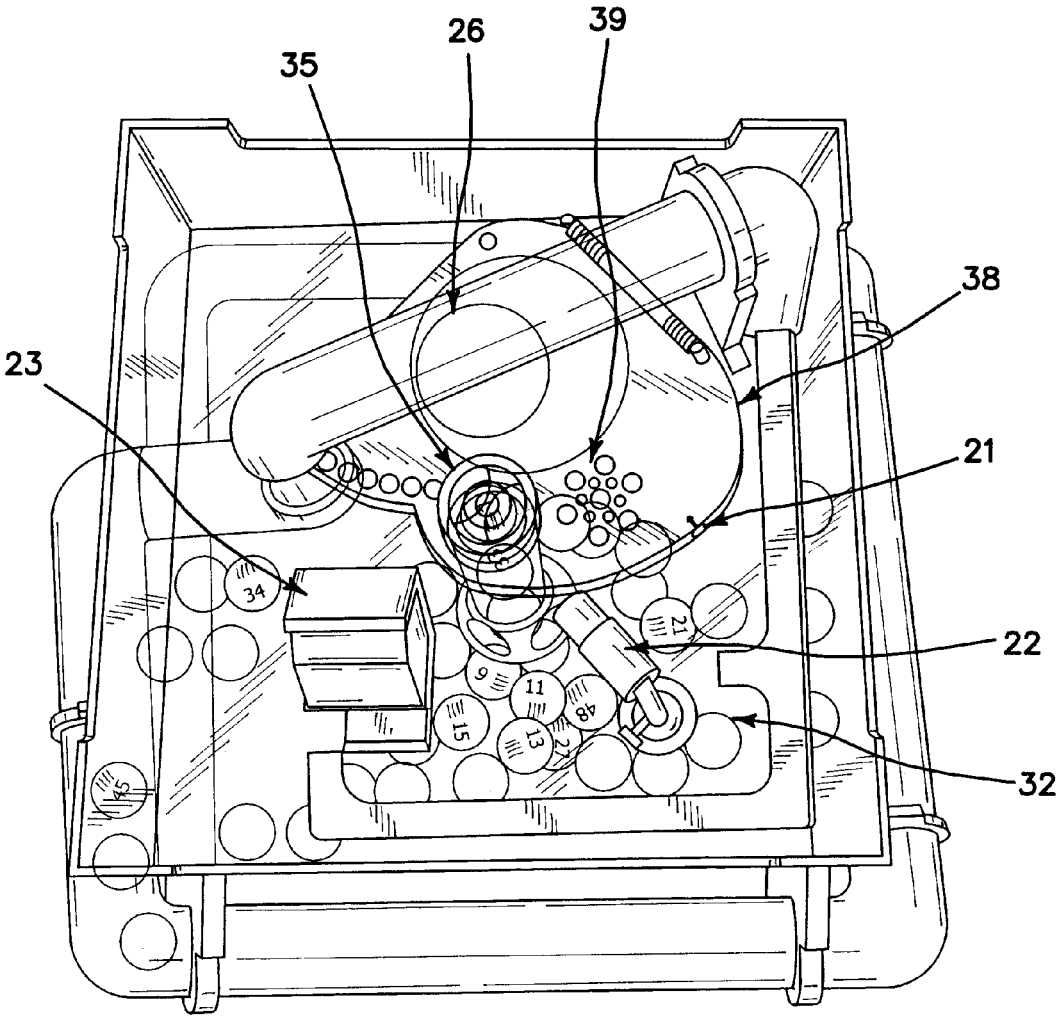
FIG. 8 illustrates an upper view of an embodiment of a smart ball blower with a ball positioned such that the number thereon is exposed to a TV camera.

Referring again to FIG. 3, the support plate 5 supports a spring-loaded (by spring 20) ball carriage mechanism 21 slidably mounted on the top surface 22 of the support plate 5. A digital TV camera 22 and barcode reader or scanner 23 is mounted adjacent thereto on the top surface 22 of the support plate 5. In one embodiment, the barcode scanner 23 is omni-directional. A stepper motor 24 (see FIG. 4), having a circular frictional gear disc 26 securely mounted on the shaft of the motor 24 (see FIG. 8), is mounted on the bottom surface 25 of the support plate 5. The gear 26 frictionally engages an inner surface of a camera opening 27 in the carriage 21 as shown in FIG. 2.

Referring now to FIG. 5, the support stand 2 is fabricated of wood or other rigid material and is configured to house two air blowers, namely, a main air blower 28 and an auxiliary air blower 29. However, the support stand 2 can also be fabricated to house more or fewer than two air blowers 28, 29. The main air blower 28 is attached to the mixing chamber 1 at a bottom opening via a manifold 30 while the auxiliary air blower 29 is attached to a bottom inlet of the reverse U-shaped auxiliary tube 10.

In addition to the two air blowers 28, 29, the support stand 2 is also configured to house a processor or computer 31 (e.g., personal computer) and other electronic components (not shown). The computer 31 is programmed to electronically control the air blowers 28, 29, the TV camera 22, the barcode reader or scanner 23, the stepper motor 24 and/or the solenoid 18. Optionally, the computer 31 may communicate with a reflective photo-interrupter (not shown).

The mixing chamber 1 houses a plurality of plastic balls 32, e.g., seventy-five bingo balls 32. Each of the plastic balls 32 can be individually marked or imprinted with a unique ball number 33 and a unique barcode 34 corresponding to the ball number 32 as best shown in FIG. 3. In one embodiment the balls 32 are hollow (i.e., filled with air).

In one embodiment as described above, a majority of operations of the automatic ball blower are controlled by the computer 31. Before a round of game (e.g., bingo) begins, the computer 31 deactivates both the main blower 28 and the auxiliary blower 29 as well as the solenoid 18 and the stepper motor 24. As a result, the spring loaded shaft 17 of the solenoid 18 returns to its normal closed (extended) position and the spring loaded carriage 21 returns to its default position in which the ball capture cup 35 of the ball carriage 21 is positioned over the outlet (top opening) of the ejecting tube 7.

Figure 6:
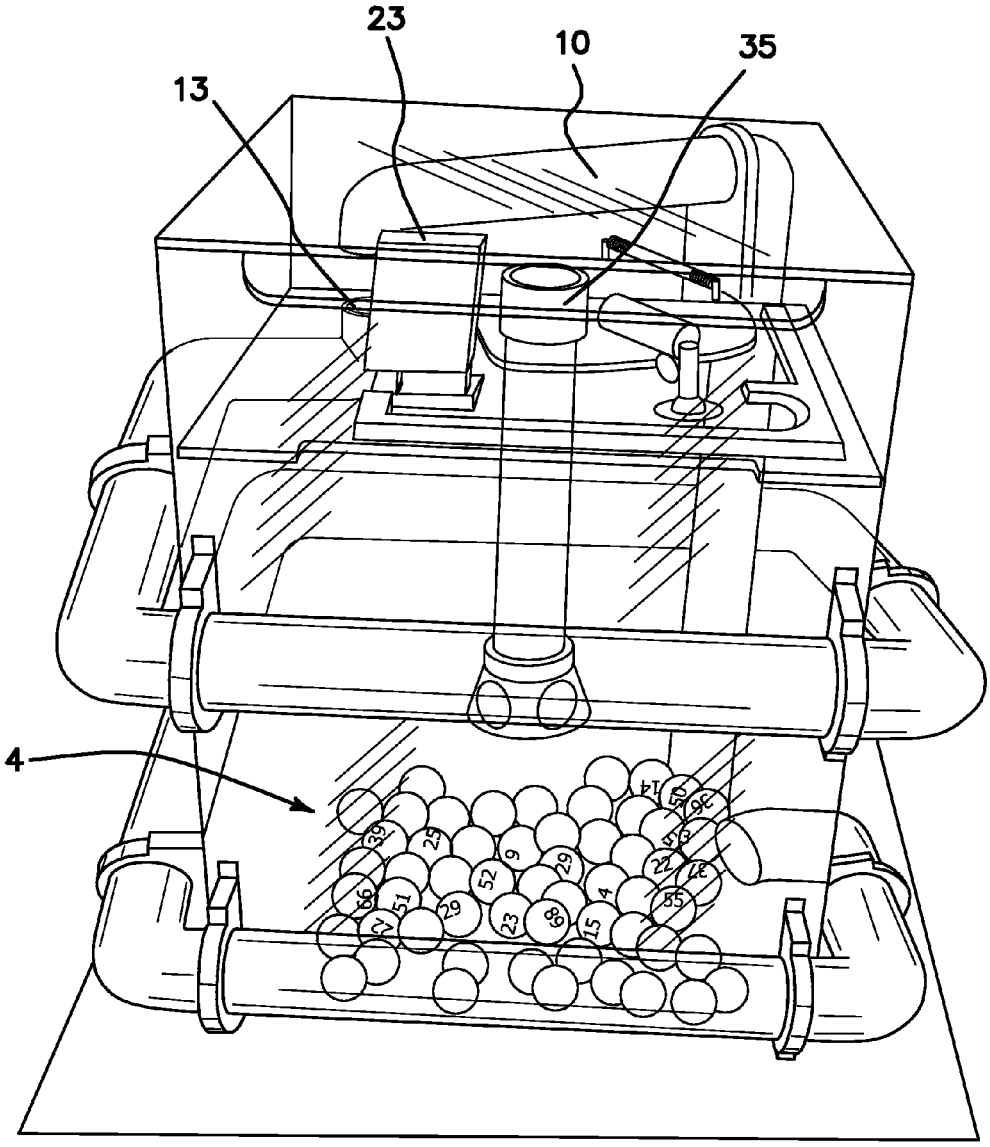
FIG. 6 illustrates a perspective view of an embodiment of a smart ball blower prior to it being activated.

As a result of the blowers 28, 29 being deactivated or switched off, each of the plastic balls 32 within the mixing chamber 1 rest at the bottom of the mixing chamber 1 and tend to congregate near the center of the inverted pyramid 4 as best shown in FIG. 6. When the game begins, the computer 31 activates both the main blower 28 and the auxiliary blower 29. The main blower 28 generates an air stream 36 directed through the air inlet opening at the bottom of the inverted pyramid 4 (see FIG. 1). The air stream 36 suspends and randomly mixes the plastic balls 32 and at some point in time, randomly ejects a ball 37 into the ejecting tube 7 in a manner well-known in the industry.

Figure 7:
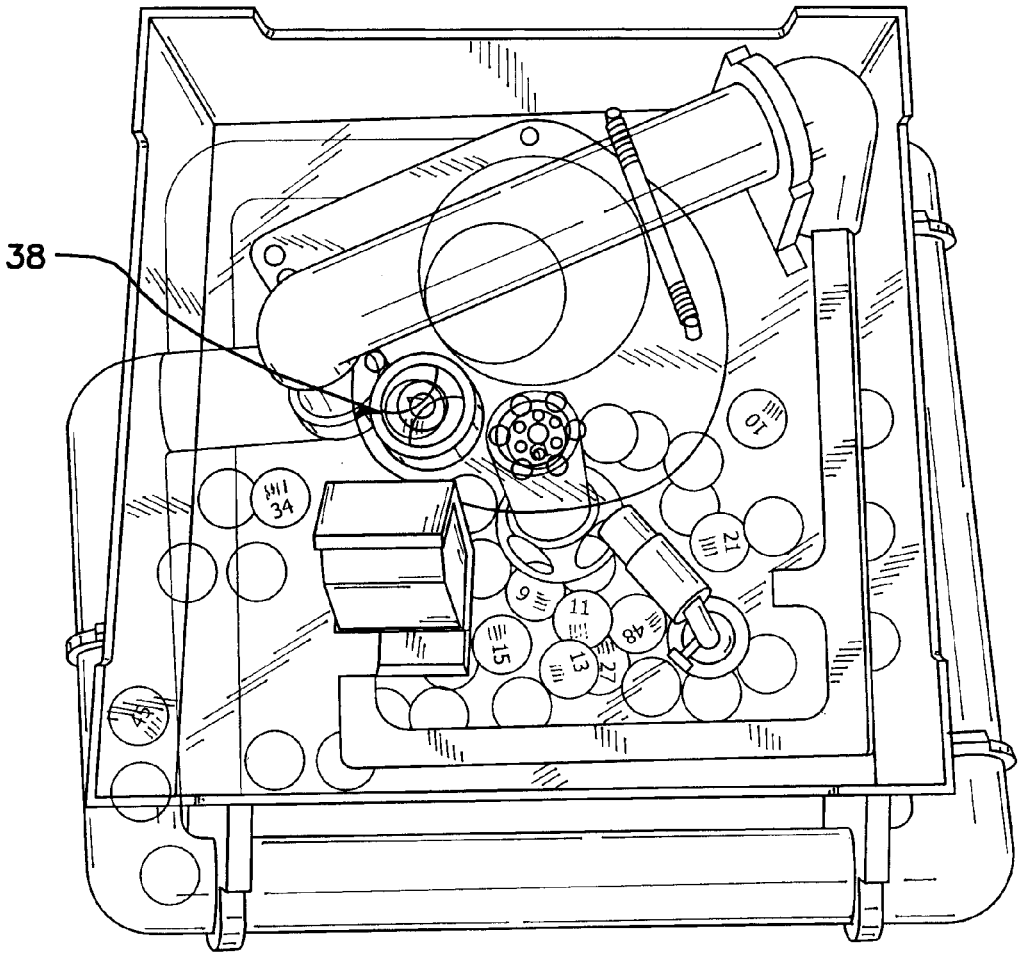
FIG. 7 illustrates an upper view of an embodiment of a smart ball blower with a ball positioned such that it can be scanned by a barcode scanner.

The randomly-ejected ball 37 travels to a cup 35 having a mesh cover top 38 (see FIGS. 3 and 7). While the mesh 38 allows the air stream 36 to vent through the cup 35, it also prevents the randomly ejected ball 37 from escaping from the cup 35. Once the randomly-ejected ball 37 is captured inside the cup 35, its image is processed by the TV camera 22 and relayed to the computer 31 for optional display on TVs or plasma displays located in a gaming establishment (not shown). Also, once the randomly-ejected ball 37 is captured in the cup 35, it can be detected by an optional reflective photo-interrupter or other sensor (not shown) that signals the ball capture event to the computer 31.

Once the ball 37 is captured by the cup 35, the stepper motor 24 rotates the gear disk 26 clockwise (or counterclockwise) thereby causing the carriage mechanism 21 to rotate clockwise (or counterclockwise) by virtue of the frictional engagement between the gear disk 26 and the internal camera opening 27 of the carriage mechanism 21. It is understood that the gear disk 26 and the carriage mechanism 21 can also be rotatably engaged by other suitable means. As a result, the ball 37 captured in the cup 35 of the carriage mechanism 21 is moved through the field of view of the barcode reader or scanner 23. Accordingly, as the ball 37 moves through the field of view of the barcode reader or scanner 23, the scanner 23 captures the barcode 34 and, based thereon, sends the scanned identification number 33 of the ball 37 to the computer 31.

Once the computer 31 receives the ball identification number 33, the stepper motor 24 moves the carriage 21 along with the captured ball 37 further clockwise (or counterclockwise) to a position directly between the inlet 13 of the ball return tube 12 and the outlet of the reversed U-shaped auxiliary tube 10. In this position, under the combined forces of gravity and pressure of the air stream 36 being blown through the auxiliary tube 10 by the auxiliary blower 29, the ball 37 drops from the cup 35 into the inlet 13 of the ball return tube 12 and travels down the tube 12 towards the outlet 16, which at this point in time, is blocked by the closed shaft 17 of the solenoid 18.

Subsequently, the stepper motor 24 returns the ball carriage 21 to its original position wherein the cup 35 is again located directly above the outlet of the central ball ejecting tube 7. From there on, the above-described process of extracting balls 37 from the ball mixing chamber 1, moving the ball 37 through a field of view by the carriage 21, and dropping the ball 37 into the ball return tube 12 under the combined forces of gravity and air stream 36 is repeated for every new ball 37 until the game concludes, e.g. until twenty balls 32 are extracted from the mixing chamber 1 during a conventional keno game. Each of the balls 32 which are extracted subsequently accumulate at one end 16 of the tube 12 under gravity and pressure of the auxiliary air stream 36 generated by the auxiliary blower 29 as best shown in FIG. 1.

Once the game concludes, the computer 31 commands the main air blower 28 to switch off and the solenoid 18 to pull-in the shaft 17 thereby allowing the balls 32 accumulated in the tube 12 to return to the mixing chamber 1 under the pressure of the auxiliary air stream. Once each of the balls 32 are fully ejected from the tube 12 back into the mixing chamber 1 (as may optionally be detected by a second reflective photo-interrupter), the computer 31 restarts the main blower 28 and repeats the above-described process for the next game.

Note that the auxiliary air stream generated by the auxiliary air blower 29 greatly facilitates the process of rolling the balls 32 down the tube 12. Without the auxiliary air stream, balls 32 may tend to cling to the walls of the tube 12 because of electrostatic forces, and gravity alone may not be sufficient to cause the balls 32 to roll into the ball mixing chamber 1 unless the incline of the tube 12 is very steep thereby enlarging the overall size of the smart ball blower. The auxiliary air stream also alleviates the tendency of the balls 32 to electrostatically collect together at the bottom of the mixing chamber 1 at the beginning of the game.

Note also that the tube 12 accumulates each of the balls 32 ejected from the ball ejection tube 7 during the current round of the game and preserves the order in which the balls 32 were ejected, i.e., preserves the history of the game. Since the tube 12 is preferably transparent, the history of the game can be easily ascertained by reviewing the balls 32 contained within the tube 12.

The present invention exemplified by the embodiments described above can be implemented in many other ways without departing from its main principles. In particular, the auxiliary air blower 29 does not necessarily have to be mounted on the inside of the support stand 2 and may, for example, be implemented as a simple fan mounted directly on the top of the support plate 5. Although two separate air blowers 28, 29 are described above, only one such device may be sufficient to generate both the main and auxiliary air streams using a Y-shaped manifold for splitting the air from a single air blower. Moreover, the Y-shaped manifold may be embedded with control valves to allow for separate controls of each of the air streams.

Also, the stepper motor 24 may be implemented as a reversible stepper motor allowing the computer 31 to move the carriage mechanism 21 back and forth in front of the barcode reader or scanner 23 as needed to facilitate scanning the ball barcode 34 or ball number 33. If the barcode 34 cannot be read even after a predetermined number of back and forth oscillations of the carriage mechanism 21 in front of the reader or scanner 23, the computer 31 signals an error condition and stops the game while awaiting human intervention.

The carriage 21 may also incorporate a wing 38 that covers the outlet of the central ball ejecting tube 7 when the cup 35 is positioned directly above the inlet 13 of the ball tube 12. By closing the outlet of the central ball ejecting tube 7, the wing 38 causes air pressure inside of the tube 7 to build-up and as a result, any balls 32 that may be inside of the tube 7 at the time may drop back into the mixing chamber 1. The wing 38 also has the ability to prevent the undesirable effect of several balls 32 accumulating inside the ball ejection tube 7. Since the mixing chamber 1 and the ejection tube 7 are preferably transparent, players can view the contents of the ejection tube 7, i.e., know in advance the ball that is about to be ejected from the tube 7 unless such ball is dropped back into the mixing chamber 1. Also, the carriage 21 may have perforations 39 which increase the speed of ejection of the next ball 37 into the tube 7 while the cup 35 moves back from the position above the inlet 13 of the return tube 12 into the position directly above the ball ejection tube 7.

Although the air mixing chamber 1 as shown in FIG. 1 is a rectangular prism 3, the air chamber 1 may also be implemented as a circular or semicircular prism or any polygonal forms and shapes. Similarly, the ball return tube 12 does not necessarily have to be implemented as a descending staircase 12. It may, for example, be implemented as a down-spiraling pipe leading from the top to the bottom of the air mixing chamber 1. Moreover, the ball return tube 12 does not necessarily have to extend around the ball mixing chamber 1 on the exterior surface but may instead be totally enclosed within the interior surface of the ball mixing chamber 1.

Note that the overall length of the ball return tube 12 can be varied to accommodate a specific number of balls required to be drawn from a particular game. For example, in a British-style bingo game, the ball return tube 12 has to be able to accommodate up to ninety balls while seventy-five balls are drawn for an American-style bingo game, twenty balls are drawn for a keno game and six balls are drawn for a typical lottery game.

Further, a co-pending application to the same assignee discloses event ticket games, only a single ball 37 is required to determine an outcome of the game. In such a game, as soon as the ejected ball 37 is read by the barcode scanner 23, the ball 37 may be immediately returned to the ball mixing chamber 1. For this type of application, the ball return tube 12 may not even be necessary or may be very short and simply constitute a U-shaped extension of the central ball ejection tube 7, while the function of the carriage 21 may be performed by a solenoid 18 that temporarily arrests the ejected ball 37 in order to facilitate reading of the barcode 34 by the reader or scanner 23 and the capturing of the video image of the ball 37 by the TV camera 22. Note that such a simplified embodiment also eliminates the need for the auxiliary air blower 29 and the auxiliary air tube 10 as well.

Having a built-in Ethernet adapter, the smart ball blower may be utilized either as a free-standing ball blower installed in a bingo room or in tandem with another similar ball blower (having a different Internet Protocol address) to form a bingo caller desk with one smart ball blower being utilized for calling regular session bingo games while the other smart ball blower may be utilized for calling special bingo games such as bonanza bingo games. Note also that while the computer 31 is fully capable of automatically controlling the random number generation process, in some environments, e.g., a typical bingo hall, the bingo caller may manually control at least some operations of the ball mixer by inputting respective commands into the computer 31 via a keyboard, mouse or touch screen.

The ball blower 10 is intended to be operated by a bingo caller who enters respective commands into the computer 31 via a keyboard, mouse or touch screen. Under the conventional wisdom, the bingo players are absolutely forbidden to exercise any control over the ball blower 10. The embodiments of the present invention involve a totally contrarian approach, namely, providing at least one bingo player with a remote game controller 3 that wirelessly sends commands to the computer 31, and by doing so, relegating, in one embodiment, a bingo caller to a passive role of an observer of a bingo player's actions.

Figure 9:
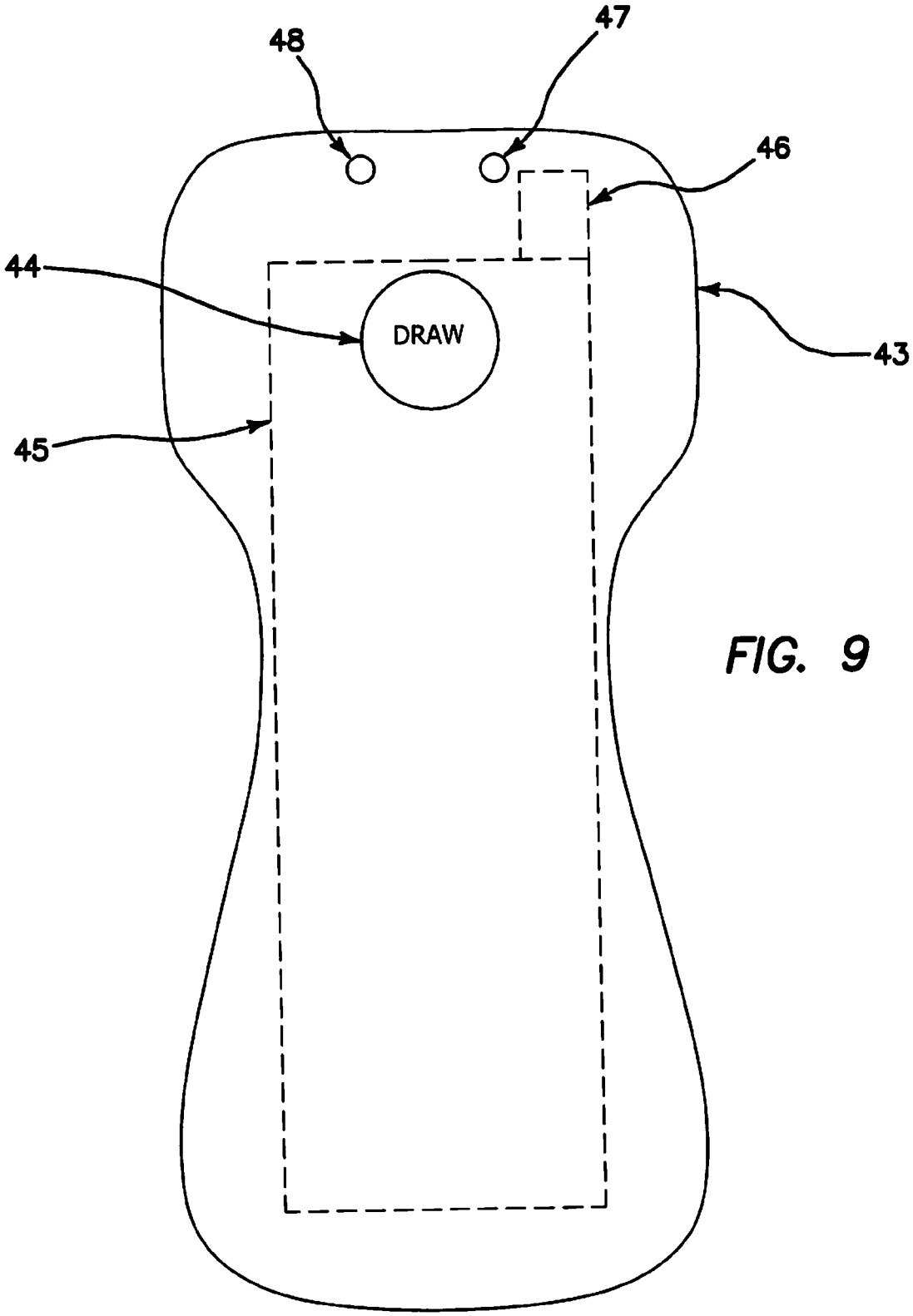
FIG. 9 illustrates a remote controller adapted for a bingo player use according to the embodiments of the present invention.

Specifically, one embodiment of the present invention involves providing a bingo player with a remote controller 43 as illustrated in FIG. 9. The remote controller 43 is equipped with a single push button 44 labeled "Draw." The remote controller 43 may be equipped with an embedded microcomputer 45 which may be equipped with a radio transceiver 46, such as a WiFi transceiver. The microcomputer 45 is responsive to the push button 44. The microcomputer 45 also controls power and communication status LED indicators 47 and 48, respectively.

The designated bingo player selected to use the remote controller 43 may be randomly determined, purchased by the player, determined by a bingo game winner or otherwise determined.

Figure 10:
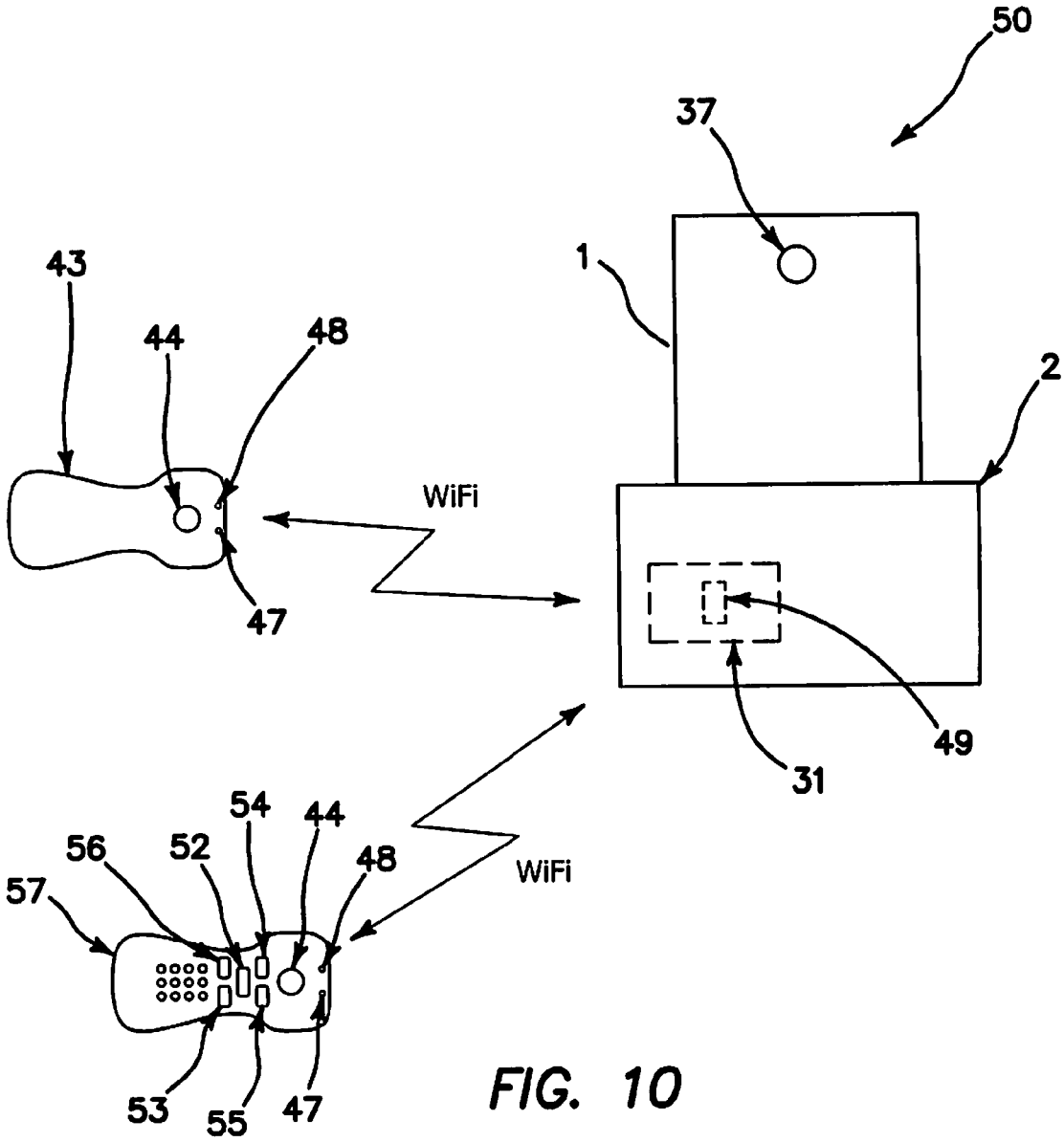
FIG. 10 illustrates a communication between a remote controller and an automatic ball blower according to the embodiments of the present invention.

The computer 31 of the ball blower 10 is also equipped with a radio transceiver 49, such as a WiFi transceiver, whereby the transceivers 46 and 49 maintain radio communication between the remote controller 43 and the ball blower 10 utilizing, in one embodiment, an assured delivery communication protocol, such as TCP/IP as illustrated in FIG. 10. The on-going communication between the remote controller 43 and the ball blower 10 results in ball blower 10 being responsive to commands sent wirelessly by the remote controller 43.

When a bingo player presses button 44, the remote controller 43 wirelessly commands the ball blower 10 to draw a ball 37 from the mixing chamber 1, and the latter (ball blower 10) being responsive to the former (controller 43), draws the ball 37 from the mixing chamber 1. The bingo caller does not participate in the drawing of the bingo ball 37, and yet, the ball 37 becomes an officially drawn ball for the current bingo game. Accordingly, the designated player is responsible for drawing bingo balls.

Figure 11:
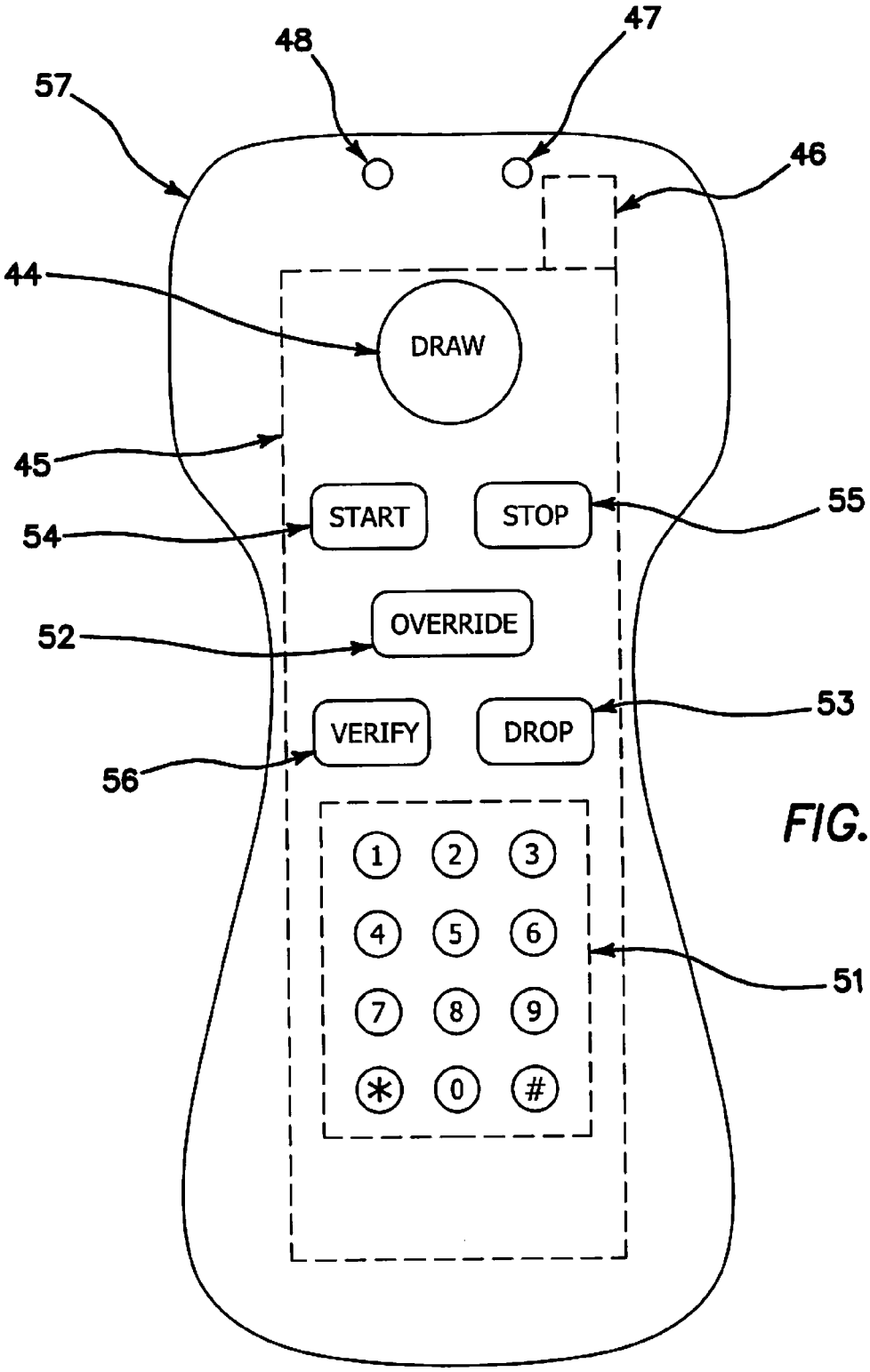
FIG. 11 illustrates a remote controller adapted for use by a bingo caller according to the embodiments of the present invention.

In another embodiment, the remote controller 43 may be equipped with a number of additional control buttons. For example, various additional buttons may be incorporated into the remote controller 43. In particular, the remote controller 43 may be adapted, as illustrated in FIG. 11, for operation by a bingo caller rather than by a bingo player wherein a modified remote controller 57 incorporates a general purpose twelve-button telephone-style keypad 51 and special function buttons "Override" 52, "Drop" 53, "Start" 54, "Stop" 55 and "Verify" 56. The push button "Override" 52 may be used by the caller to override (cancel) an erroneous player's command "Draw", e.g., if a player commands to draw the next ball too early or too late in a violation of a house rule, such as the rule against drawing a ball less than every ten seconds. To limit player errors, the remote controller 43 may include an LED or other indicator to alert the player when he or she can press the Draw button 44. Specifically, the caller operated remote controller 57 then sends a wireless command to computer 31, via its embedded WiFi adapter 49, to cancel a previously issued command received from the player-operated remote controller 43. The push button "Drop" 53 may be utilized by the caller to remotely command the blower 10 to return (drop) all drawn balls into the mixing chamber 1 at the end of the game. In combination with the numeric keypad 51, the button "Verify" 56 may be utilized by the bingo caller to verify a particular bingo card, e.g., utilizing a smart flashboard, such as disclosed in U.S. Pat. No. 7,566,058 (owned by applicant), whereas the buttons "Start" 54 and "Stop" 55 may be utilized by the caller to remotely start and stop, respectively, the main air mixing pump 28 of the ball blower 10.

Note that in addition to, or in lieu of, push buttons 51 through 56 the remote controllers and 57 may also be equipped with embedded LCD displays, touch-screens or other user interfaces. Moreover, the embodiments of the present invention may be used with any draw type game such as keno and lottery games such that a player may be permitted to control the draw of keno balls or lottery numbers. In addition, the remote controller embodiments of the present invention may be used with any suitable ball blowers and the ball blower described and shown herein is intended to be exemplary only.

Although the invention has been described in detail with reference to several embodiments, additional variations and modifications exist within the scope and spirit of the invention as described and defined in the following claims.

We claim:

1. A system for mixing a first plurality of balls in a ball mixing chamber to play a game, comprising:

a ball blower responsive to a wireless remote controller wherein said remote controller is configured to command said ball blower to draw a second plurality of balls from said first plurality of balls for use in said game, said second plurality of balls affecting an outcome of said game.

2. The system of claim 1 wherein said remote controller is further configured to command said ball blower to perform at least one of the following actions:

(a) start ball mixing;

(b) end ball mixing;

(c) drop all drawn-out balls into said ball mixing chamber; and (d) override a prior command remotely send to said ball blower.

3. The system of claim 1 wherein said game is bingo, keno or lottery.

4. The system of claim 1 wherein said remote controller is further configured to issue a command to verify a game card.

5. A system for mixing a plurality of balls in a ball mixing chamber to play a game, comprising:

a ball blower responsive to multiple wireless remote controllers;

a first wireless remote controller operable by a player of said game, said first remote controller configured to command said ball blower to draw at least one ball for use in said game from said plurality of balls; and a second wireless remote controller operable by a bingo caller, said second wireless remote controller configured to override commands of said first wireless remote controller.

6. The system of claim 5 wherein said first and/or second remote controller is further configured to command said ball blower to perform at least one of the following actions:

(a) start ball mixing;

(b) end ball mixing;

(c) drop all drawn-out balls into said ball mixing chamber; and (d) override a prior command remotely send to said ball blower.

7. The system of claim 5 wherein said game is bingo, keno or lottery.

8. The system of claim 5 wherein said first and/or second remote controller is further configured to issue a command to verify a game card.

9. A method of playing a game utilizing a device for mixing a first plurality of balls in a ball mixing chamber, comprising:

configuring a ball blower to respond to a wireless remote controller; and configuring said remote controller to command said ball blower to draw a second plurality of balls from said first plurality of balls for use in said game, said second plurality of balls affecting an outcome of said game.

10. The method of claim 9 further comprising configuring said remote controller to command said ball blower to perform at least one of the following actions:

(a) start ball mixing;

(b) end ball mixing;

(c) drop all drawn-out balls into said ball mixing chamber; and (d) override a prior command remotely send to said ball blower.

11. The method of claim 10 wherein said game is bingo, keno or lottery.

12. The method of claim 10 further comprising configuring said remote controller to issue a command to verify a game card.

13. A method of playing a game utilizing a device for mixing a first plurality of balls in a ball mixing chamber, comprising:

utilizing a ball blower configured to respond to a wireless remote controller to command said ball blower to draw a second plurality of balls from said first plurality of balls for use in said game from said second plurality of balls, said second plurality of balls affecting an outcome of said game; and allowing a player of said game to control the ball blower with said remote controller.

14. The method of claim 13 further comprising configuring said remote controller to command said ball blower to perform at least one of the following actions:

(a) start ball mixing;

(b) end ball mixing;

(c) drop all drawn-out balls into said ball mixing chamber; and (d) override a prior command remotely send to said ball blower.

15. The method of claim 13 wherein said game is bingo, keno or lottery.

16. The method of claim 13 further comprising configuring said remote controller to issue a command to verify a game card.

17. A method of playing a game utilizing a device for mixing a first plurality of balls in a ball mixing chamber, comprising:

utilizing a ball blower configured to respond to a wireless remote controller to command said ball blower to draw a second plurality of balls from said first plurality of balls for use in said game from said second plurality of balls, said second plurality of balls affecting an outcome of said game; and allowing an operator of said game to control the ball blower with said remote controller.

18. The method of claim 17 further comprising configuring said remote controller to command said ball blower to perform at least one of the following actions:

(a) start ball mixing;

(b) end ball mixing;

(c) drop all drawn-out balls into said ball mixing chamber; and (d) override a prior command remotely send to said ball blower.

19. The method of claim 17 wherein said game is bingo, keno or lottery.

20. The method of claim 17 further comprising configuring said remote controller to issue a command to verify a game card.

21. A method of playing a game utilizing a device for mixing a plurality of balls in a ball mixing chamber, comprising:

utilizing a ball blower configured to respond to multiple wireless remote controllers;

allowing a player of said game to control the ball blower with a first remote controller to command said ball blower to draw at least one ball for use in said game from said plurality of balls; and allowing a bingo caller of said game to utilize a second remote controller to override commands of said first remote controller.

22. The method of claim 21 wherein said first and/or second remote controller is further configured to command said ball blower to perform at least one of the following actions:

(a) start ball mixing;

(b) end ball mixing;

(c) drop all drawn-out balls into said ball mixing chamber; and (d) override a prior command remotely send to said ball blower.

23. The method of claim 21 wherein said game is bingo, keno or lottery.

24. The method of claim 21 wherein said first and/or second remote controller is further configured to issue a command to verify a game card.

* * * * *